US007831172B2

(12) United States Patent
Silva et al.

(10) Patent No.: US 7,831,172 B2
(45) Date of Patent: Nov. 9, 2010

(54) PIN DRIVER

(75) Inventors: Gary Silva, Reseda, CA (US); Valeriy Kiselev, Pasadena, CA (US); Gerardo Martinez, Winnetka, CA (US); Tigran Ohanyan, Burbank, CA (US); Denny Holmes, Los Angeles, CA (US)

(73) Assignee: Mitsubishi Kagaku Imaging Corporation, San Fernando, CA (US)

( * ) Notice: Subject to any disclaimer, the term of this patent is extended or adjusted under 35 U.S.C. 154(b) by 0 days.

(21) Appl. No.: 12/456,634

(22) Filed: Jun. 19, 2009

(65) Prior Publication Data

US 2009/0257775 A1 Oct. 15, 2009

Related U.S. Application Data

(63) Continuation-in-part of application No. 11/647,115, filed on Dec. 28, 2006, now Pat. No. 7,689,143.

(60) Provisional application No. 61/132,653, filed on Jun. 20, 2008.

(51) Int. Cl.
*G03G 15/00* (2006.01)

(52) U.S. Cl. ..... 399/109; 399/159

(58) Field of Classification Search ..... 399/109, 399/159

See application file for complete search history.

(56) References Cited

U.S. PATENT DOCUMENTS

| | | | | |
|---|---|---|---|---|
| 7,366,445 | B2 * | 4/2008 | Hoashi et al. | 399/167 |
| 2004/0005169 | A1 * | 1/2004 | Yokomori et al. | 399/159 |
| 2004/0034978 | A1 * | 2/2004 | Crevoisier | 29/270 |
| 2008/0159779 | A1 * | 7/2008 | Silva et al. | 399/109 |

* cited by examiner

*Primary Examiner*—Ryan D Walsh

(57) ABSTRACT

The present invention also includes a method of remanufacturing a printer cartridge, the printer cartridge comprising printer cartridge components fastened together by a pin, the method comprising the steps of providing a device, the device comprising a shaft configured to apply pressure to the pin; a drive means for driving the shaft against the pin; and applying pressure to the pin using the device.

18 Claims, 20 Drawing Sheets

PIN DRIVER

CROSS REFERENCES TO RELATED APPLICATIONS

This is a continuation-in-part application of U.S. patent application Ser. No. 11/647,115 filed Dec. 28, 2006 now U.S. Pat. No. 7,689,143. This application also claims priority to U.S. provisional patent application Ser. No. 61/132,653 filed Jun. 20, 2008, which is incorporated herein by reference.

FIELD OF INVENTION

The present invention relates to electrophotography, particularly methods and apparatus for remanufacturing toner cartridges.

BACKGROUND

Used printer cartridges of fax machines, copiers, inkjet printers, and laser printers are often remanufactured. Printer cartridges typically include a toner hopper, a waste hopper, primary charge roller or PCR, a developer roller, and a drum. The drum is usually one of the components that wears out from usage and gets replaced during remanufacturing. The drum is typically attached to a drum axle, which is connected to a motor of the printer and allows the motor to rotate the drum. In some cartridges, the drum is attached to the drum axle with a mechanical spring pin that is inserted through a plastic cap portion of the drum and a portion of the drum axle. Examples of these cartridges include cartridges for Hewlett-Packard laser printer model numbers 3000, 3500, 3600, 3700, and 3800.

In addition to the mechanical spring pin attaching the drum to the drum axle, in some cartridges, a spring pin also attaches the drum axle to a drive element. The spring pin is also inserted through the drive element and a portion of the drum axle. The drive element of the printer cartridge is configured to fit to a drum drive gear of a printer to allow the printer to rotate the drum axle and the drum. Examples of these cartridges include cartridges for Hewlett-Packard laser printer model number 4700.

To detach the printer cartridge components joined by the spring pin, a hammer and a chisel is conventionally used. For instance, the chisel is first aligned with the mechanical spring pin. Once the chisel is aligned, a hammer is used to cause the chisel to drive the mechanical spring pin until it no longer holds the printer cartridge components. Other conventional methods include using a punch in lieu of the chisel. The punch may include a flatter head than the chisel, which provides a wider surface of pin contact than the chisel. Consequently, the punch may more effectively contact and drive the mechanical spring pin.

At least one problem with the conventional methods and tools is that they expose the drum to being damaged. For instance, the drum may include drum caps made of soft plastic. Since irregular force is applied to the drum cap by the hammer, the chisel, or the punch, the soft plastic of the drum cap may be deformed. Conventional tools may also damage the mechanical spring pin. Another problem with the conventional tools is that they may be difficult to use. The chisel or the punch may contact the mechanical spring pin, but may easily slip from the mechanical spring pin. Thus, the conventional methods and tools may not be desirable in high volume cartridge remanufacturing environments. Methods and apparatus for efficiently and quickly detaching and reattaching printer cartridge components joined by a spring pin are desired and are addressed by the present invention.

BRIEF DESCRIPTION

The present invention includes a device for remanufacturing a printer cartridge, the printer cartridge comprising at least two printer cartridge components attached together by a pin, the device comprising: a shaft configured to apply pressure to the pin; a frame connected to the shaft, the frame configured to provide support to the shaft; a cartridge mount connected to the frame; the cartridge mount configured to support a cartridge portion when the shaft applies pressure to the pin.

The present invention also includes a method of remanufacturing a printer cartridge, the printer cartridge comprising printer cartridge components fastened together by a pin, the method comprising the steps of providing a device, the device comprising a shaft configured to apply pressure to the pin; a drive means for driving the shaft against the pin; and applying pressure to the pin using the device.

The above description sets forth, rather broadly, a summary of embodiments of the present invention so that the detailed description that follows may be better understood and contributions of the present invention to the art may be better appreciated. Some of the embodiments of the present invention may not include all of the features or characteristics listed in the above summary. There may be, of course, other features of the invention that will be described below and may form the subject matter of claims. In this respect, before explaining at least one embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF THE PREFERRED EMBODIMENTS

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention. Also, it is to be understood that the phraseology and terminology employed herein are for the purpose of description and should not be regarded as limiting.

Figure 1:
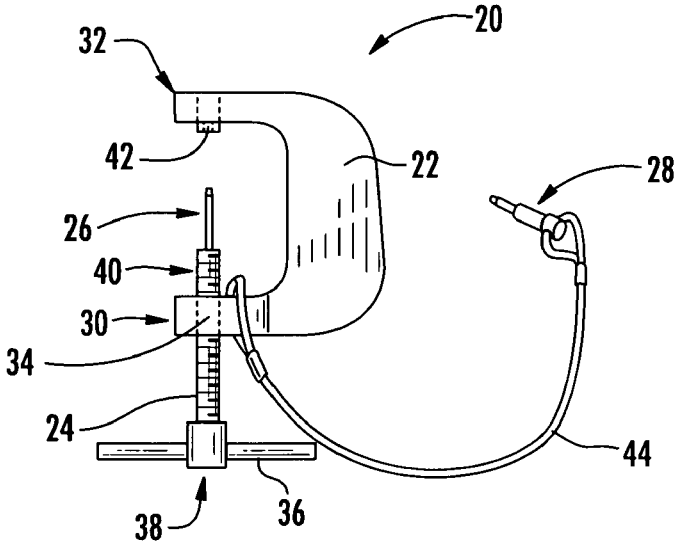
FIG. 1 is substantially a front elevational view of an embodiment of a pin driver of the present invention.

The present invention comprises various embodiments of a pin driver and related methods of use. Referring to FIG. 1, the pin driver 20 may include a tool body 22, a shaft 24, an engagement pin 26, and an alignment pin 28. The tool body 22 may have a C-shaped structure, which defines a first end 30 and a second end 32. The first end 30 is preferably positioned at the bottom of the C-shaped structure and preferably defines a first recess (not shown) proximate to the tip of the first end 30. The first recess is preferably configured to accommodate the shaft 24, which may be moved within the first recess. It can be appreciated that the first end portion 30 supports, at least partially, the movable shaft 24. Thus, the first end 30 of the tool body 22 may be thicker than the second end 32 to provide structural integrity to the first end portion 30.

The shaft 24 preferably includes continuous projecting helical ribs or male threads. The wall that surrounds the first recess preferably includes corresponding set of female threads. The shaft 24 may be turned and moved within the first recess using a handle 36 attached to a first shaft end 38. It can be appreciated that the turning of the shaft 24 either elongates or shortens the length of the shaft 24, as measured from the first end 30 of the tool body 22. It can further be appreciated that the turning of the shaft 24 moves the tool body 22 up and down the shaft 24.

The shaft 24 preferably also includes a second shaft end 40, which is opposite the first shaft end 38 where the handle 36 is positioned. An engagement pin 26 is preferably attached to the second shaft end 40. The engagement pin 26 may be another shaft with a smaller diameter than the shaft 24 and may include an edge that tapers towards the tip. The edge may further include a substantially flat surface that is perpendicular to the engagement pin shaft. As the engagement pin 26 is attached to the shaft 24, the rotation of the shaft 24 also rotates the engagement pin 26. The engagement pin 26 is preferably configured to push a mechanical spring pin to detach a drum from a drum axle, as described below.

With continued reference to FIG. 1, the second end 32 of the pin driver 20 is preferably opposite the first end 30 of the C-shaped structure of the tool body 22. In FIG. 1, the first end 30 is positioned on the bottom of the tool body 22, and thus the second end 32 is positioned on top of the tool body 22. The second end 32 preferably defines a second end recess 42 (shown in FIG. 9). The second end recess is preferably configured to accommodate the insertion of the alignment pin 28.

The alignment pin 28 is preferably tied to the shaft 24 using a tie known in the art. It is noted that the alignment pin 28 is only optionally tied to the shaft 24 to ensure that the alignment pin 28 is not misplaced or lost and to provide an alignment pin 28 that can easily be grasped when needed. The alignment pin 28 need not be tied to the shaft 24. The alignment pin 28 may also be attached elsewhere around the pin driver 20 using methods known in the art.

Figure 2:
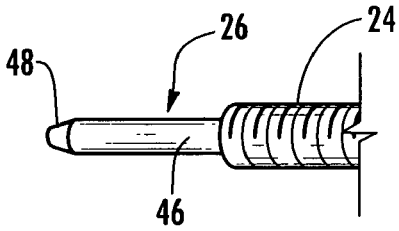
FIG. 2 is substantially a front elevational view of an embodiment of an engagement pin of the present invention.

Referring now to FIG. 2, the structure of the engagement pin 26 is shown in detail wherein the engagement pin 26 preferably includes an engagement pin shaft 46 directly attached to the shaft 24. The engagement pin shaft 46 preferably has a smaller diameter than the shaft 24. The engagement pin 26 preferably also includes a pin contact portion 48, which is preferably attached to the end of the engagement pin shaft 46 that is opposite to the end where the shaft 24 is attached. The pin contact portion 48 preferably includes a structure that tapers from the engagement pin shaft 46 to its tip. The pin contact portion 48 is preferably sized to fit inside a recess defined by the mechanical spring pin to be removed by the pin driver 20 (not shown).

Figure 3:
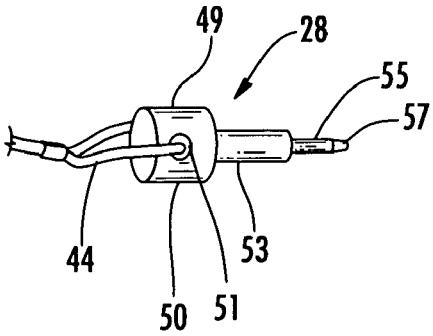
FIG. 3 is substantially a front elevational view of an embodiment of an alignment pin of the present invention.
Figure 4:
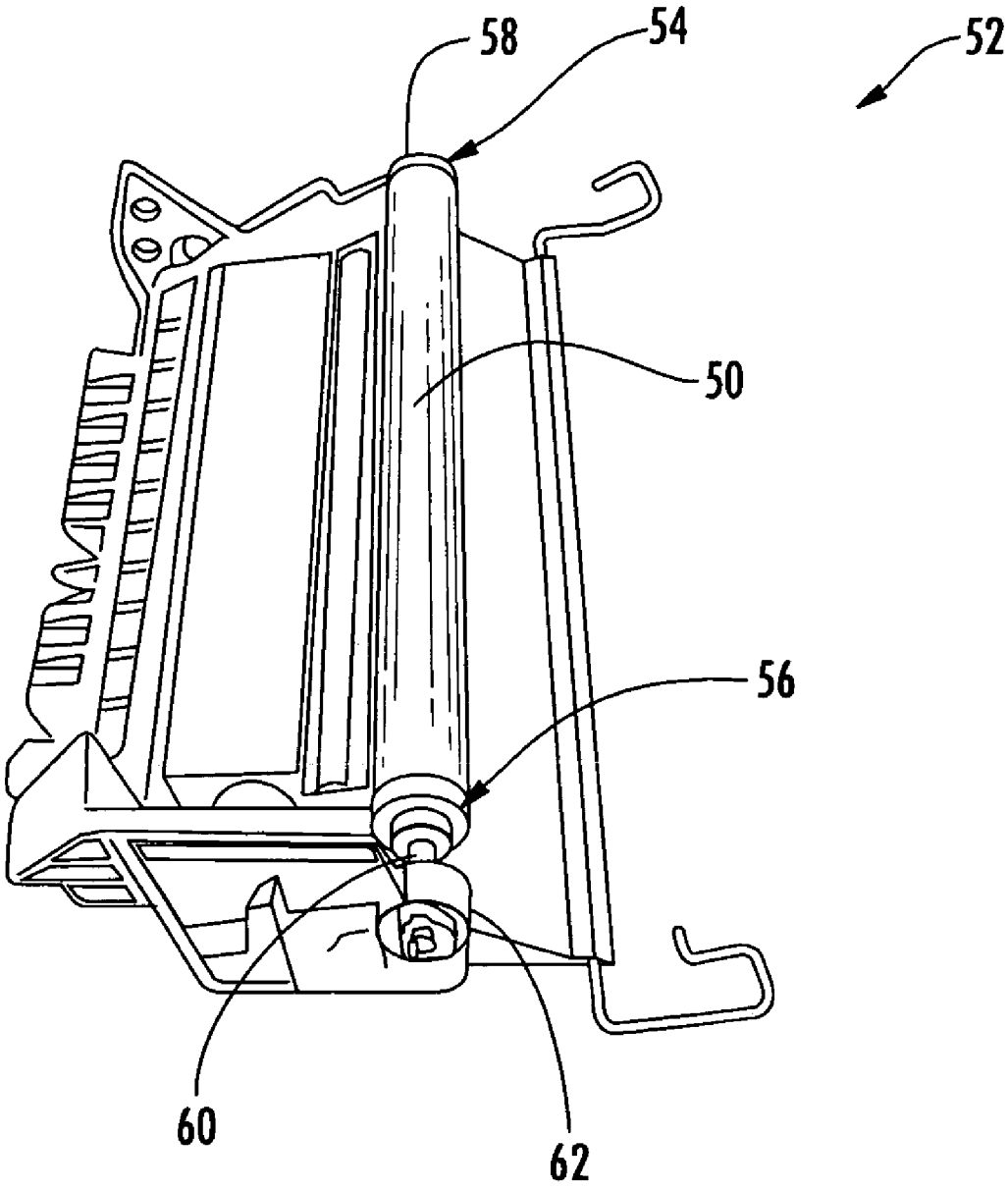
FIG. 4 (PRIOR ART)
FIG. 4 is substantially a top plan view of a prior art cartridge for which the various embodiments of the pin driver of the present invention may be used.

Referring now to FIG. 3, the structure of the alignment pin 28 is shown in detail. The alignment pin 28 preferably includes an alignment pin head 49. The alignment pin head 49 may be cylindrical in shape and may define a pin head recess 51 to accommodate a tie 44, which may be used to attach the alignment pin 28 to the pin driver 20. An alignment pin shaft 53 is preferably attached to the alignment pin head 49. The alignment pin shaft 53 preferably has a smaller diameter than the alignment pin head 49. The alignment pin 28 preferably also includes an alignment pin contact portion 55 attached to the alignment pin shaft 53. The alignment pin contact portion 55 preferably includes a cylindrical body and an edge that tapers toward the tip and forms a pointed edge 57. It is noted that in other embodiments of the pin driver, the alignment pin head 49 may not include the pin head recess 51. The alignment pin shaft 53 and the cylindrical body of the alignment pin contact portion 55 may be integrated and may have uniform diameter.

The present invention also includes methods relating to the use of the pin driver 20. Before describing one of the methods, the order in which the steps are presented below is not limited to any particular order and does not necessarily imply that they have to be performed in the order presented. It will be understood by those of ordinary skill in the art that the order of these steps can be rearranged and performed in any suitable manner. It will further be understood by those of ordinary skill in the art that some steps may be omitted or added and still fall within the spirit of the invention.

The cartridge to be remanufactured is preferably disassembled such that the drum can be accessed. In the description below, the drawings corresponding to the description depict cartridges from original equipment manufacturers (OEMs), including Hewlett Packard company's HP3700, HP 3500, HP 3800, HP 3600, and HP 3000 cartridges. It is noted that the application of the invention is not limited to Hewlett Packard cartridges. The invention may be used with cartridges from various manufacturers.

Drum Disassembly

Once a toner hopper is separated from the waste hopper, the drum 50 may be visible and accessible. A drum 50 typically has a first end 54 and a second end 56. The first end 54 is typically attached to a first cartridge portion 58 of the cartridge 52. The second end 56 is typically attached to a drum axle 60. The drum axle 60 is typically a piece of shaft that connects the drum 50 to a motor of a printer to allow the motor to rotate the drum. The drum axle is typically attached to a second cartridge portion 62.

Figure 5:
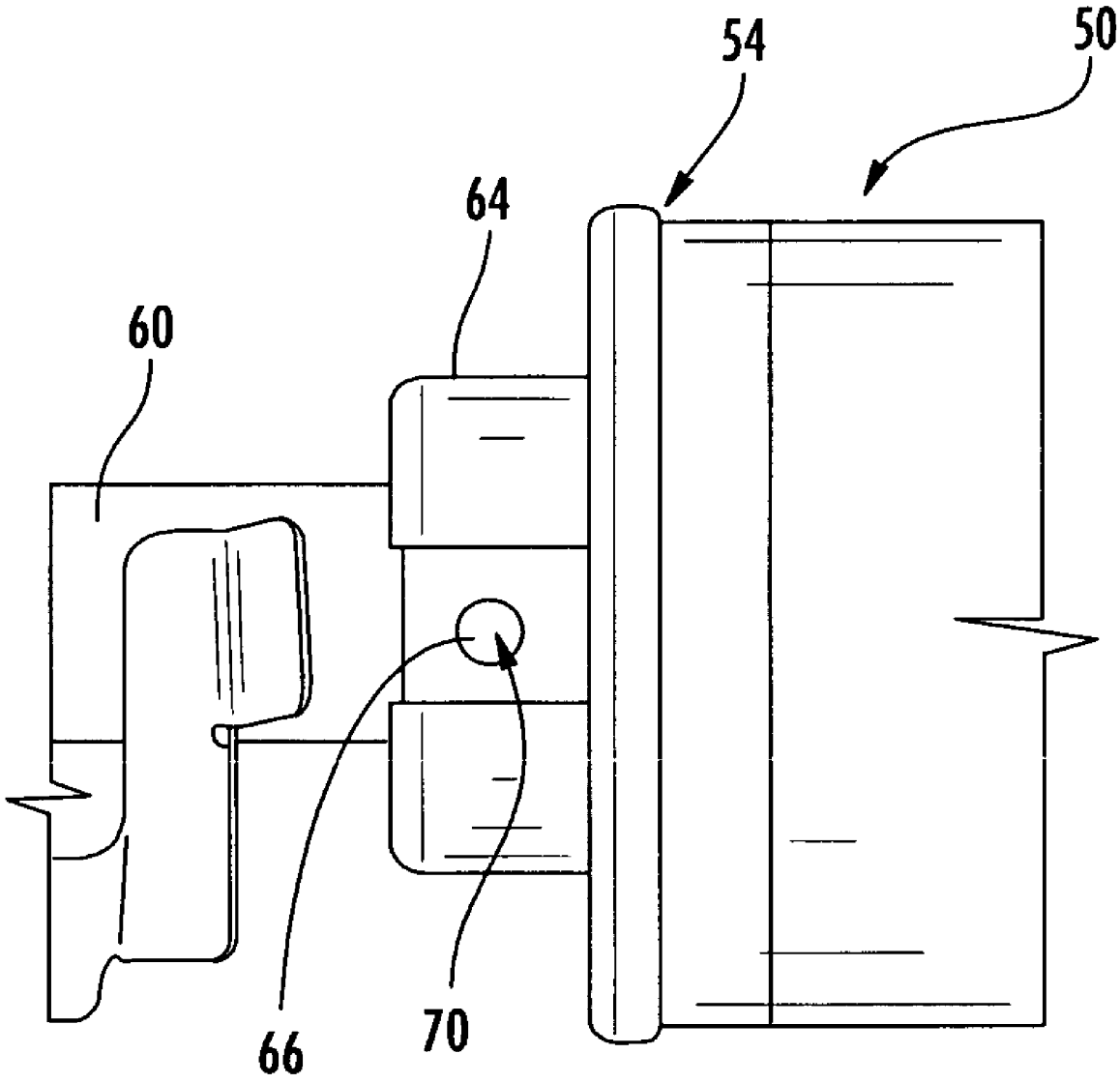
FIG. 5 (PRIOR ART)
FIG. 5 is substantially a front elevational view of the portion of the cartridge in FIG. 4 that includes the drum and the drum axle.
Figure 6:
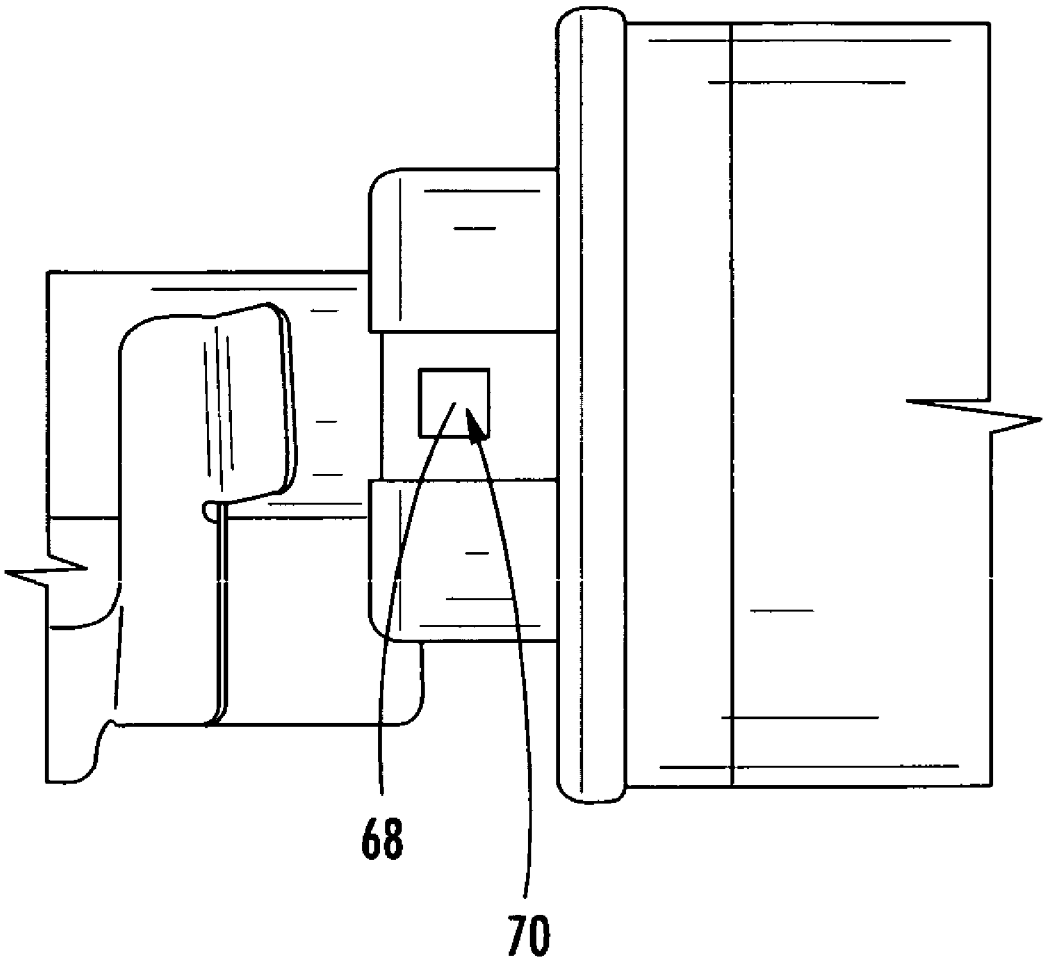
FIG. 6 (PRIOR ART)
FIG. 6 is substantially a rear elevational view of the same cartridge portion as in FIG. 5.
Figure 7:
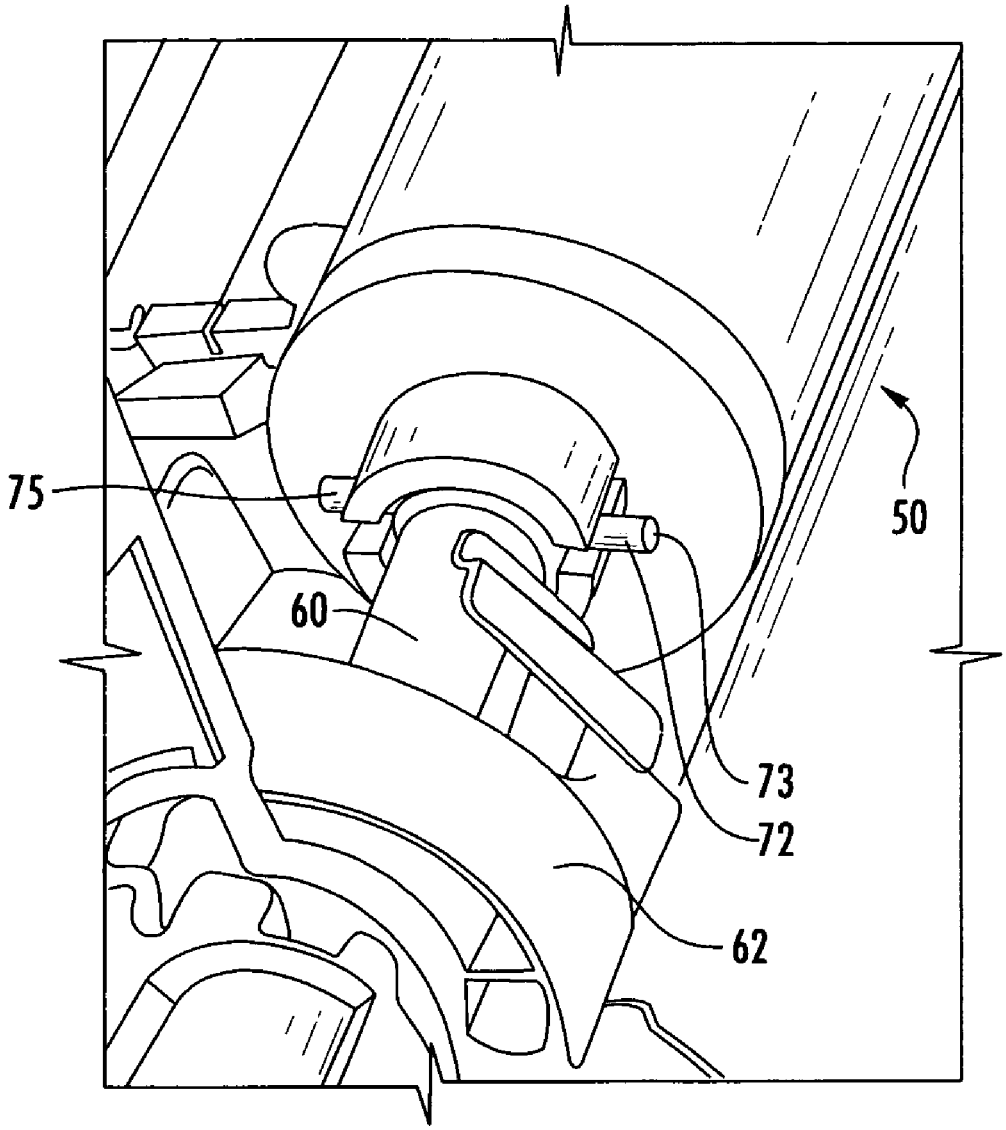
FIG. 7 (PRIOR ART)
FIG. 7 is substantially a perspective view of the same cartridge portion as in FIG. 5 with a pin attaching the drum to the drum axle.

With reference now to FIGS. 5 and 6, the first end 54 of the drum 50 may include a drum hub 64. The drum hub 64 may define a pair of opposing recesses, which may be a circular recess 66 on one end (FIG. 5) and a square recess 68 on the other end (FIG. 6). The drum hub 64 may be attached to a drum axle 60, which may define a drum axle recess. The drum axle recess may be aligned with the pair of opposing recesses 66 and 68 of the drum hub to form a pin passage 70. A drum spring pin 72 is typically inserted through the pin passage 70 to attach the drum 50 to the drum axle 60 (FIG. 7). The drum spring pin 72 may be hollow, and each drum spring pin end may define a corresponding drum spring pin recesses 73 and 75. The drum axle 60 may be attached to the second cartridge portion 62. Thus, the second end 56 of the drum 50 is indirectly attached to the cartridge via the drum axle 60.

Figure 8:
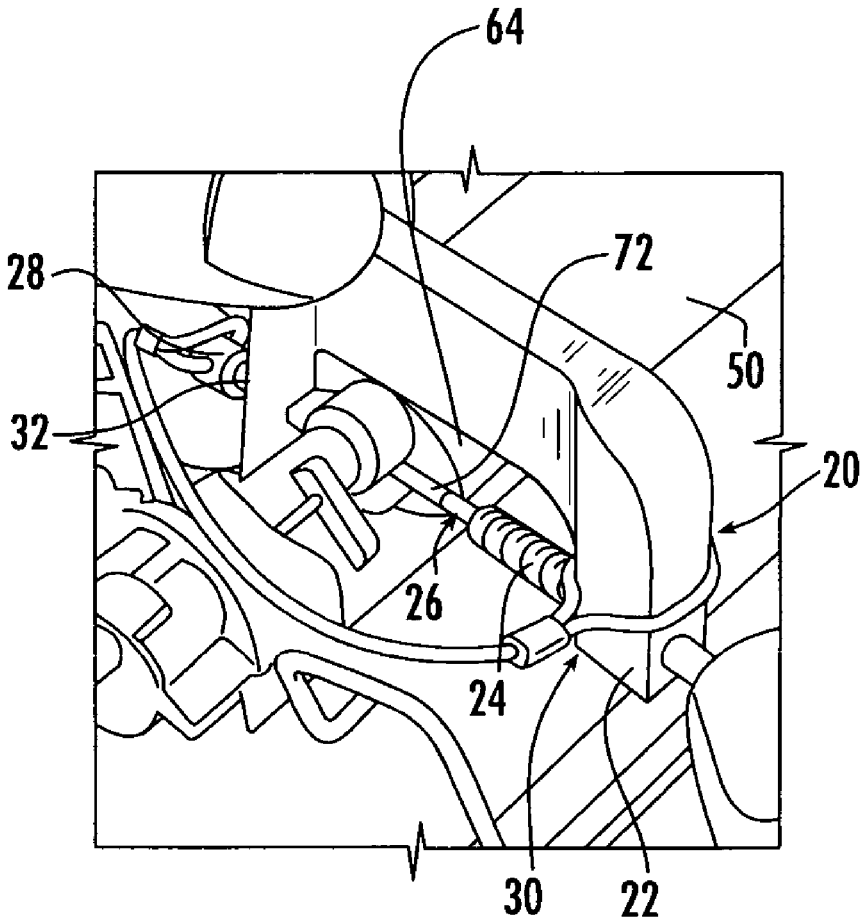
FIG. 8 is substantially a perspective view similar to FIG. 7, but with the pin driver embodiment shown in FIG. 1 being used.

Referring now to FIG. 8, once the cartridge has been disassembled to provide access to the drum 50, the pin driver 20 is preferably positioned around the drum 50 such that the C-shaped tool body 22 is over the drum hub 64. The drum hub 64 is preferably positioned in between the first end 30 and the second end 32 of the tool body 22. If the drum hub 64 is of the type that includes a circular recess on one end and a square recess on another, the drum 50 is preferably rotated such that the first end 30 of the tool body 22 is facing the circular recess. The alignment pin 28 may be inserted through the second recess 42 defined by the second end 32. The shaft 24 may be rotated, and the engagement pin 26 may be aligned with the drum spring pin 72 to be removed. Once the shaft 24 has been extended such that the engagement pin 26 contacts the drum spring pin 72, the pin contact portion 48 of the engagement pin 26 may then be inserted into the recess 73 of the drum spring pin 72.

Figure 9:
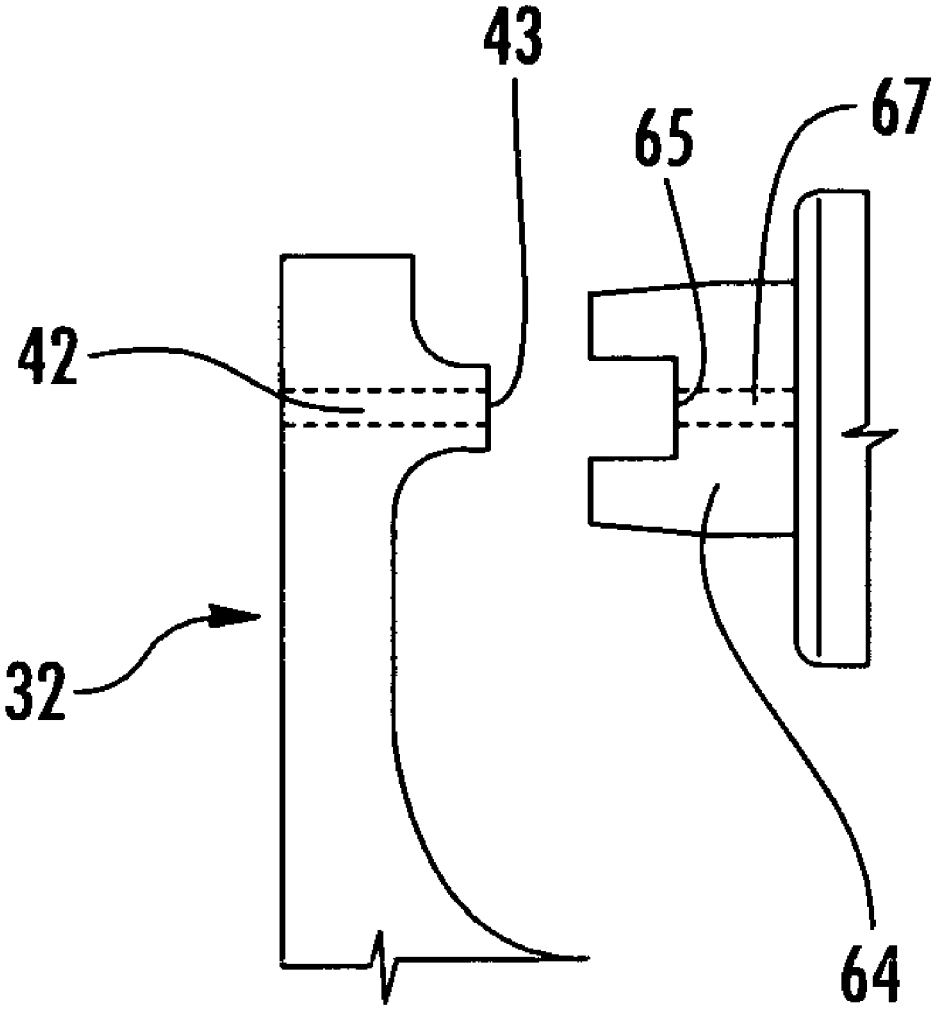
FIG. 9 is substantially a schematic view of an end of the pin driver and a portion of a drum hub to which the pin driver end may be configured to abut.

The shaft 24 may be rotated until the second end 32 of the tool body 22 abuts the drum hub 64 (FIG. 9). The drum hub 64 may include an indented sub-structure 65, which defines the recess 67 for the drum spring spin 72. The second end 32 of the tool body 22 may include a protruding portion 43 designed to fit within the indented sub-structure 65 of the drum hub. Once the protruding portion 43 of the second end 32 abuts the indented sub-structure 65 of the drum hub, the shaft 24 may be rotated until the alignment pin 28 is withdrawn from the second recess 42 and the drum spring pin 72 is detached from the drum hub. A portion of the engagement pin may have to be inserted through the pin passage to drive the drum spring pin 72 out of the drum hub. It can be appreciated that the protruding portion 43 aids in providing a much precise alignment between the second recess 42 and the pin recess 67. The precise alignment may minimize the exposure of the drum spring pin from being damaged.

Drum Re-Assembly

The pin driver 20 may provide leverage during both disassembly and re-assembly. To use the pin driver 20 during re-assembly, the pin driver 20 may be positioned around the drum 50 such that the C-shaped tool body 22 is over the drum hub 64. The drum hub 64 is preferably positioned in between the first end 30 and the second end 32 of the tool body 22. If the drum hub 64 is of the type that includes a circular recess on one end and a square recess on another, the drum 50 is preferably rotated such that the first end 30 of the tool body 22 is facing the square recess. The drum spring pin 72 is preferably inserted through the square recess. If the drum hub 64 does not have two types of recesses, then the drum spring pin 72 may be inserted through any drum hub recess.

The second end 32 may be positioned to abut the drum hub 64, and the alignment pin 28 may be inserted through the second recess 42 of the second end 32. A portion of the alignment pin 28 may be inserted through the pin passage 70 defined by the drum hub and the drum axle. The shaft 24 may be rotated, and the engagement pin 26 may be aligned with the drum spring pin 72. The pin contact portion 48 of the engagement pin 26 may then be inserted into the recess of the drum spring pin 72. The shaft 24 may be rotated until the drum spring pin 72 pushes out the alignment pin 28 or the desired length of insertion of the drum spring pin 72 through the pin passage is achieved.

Other Embodiments

Figure 10:
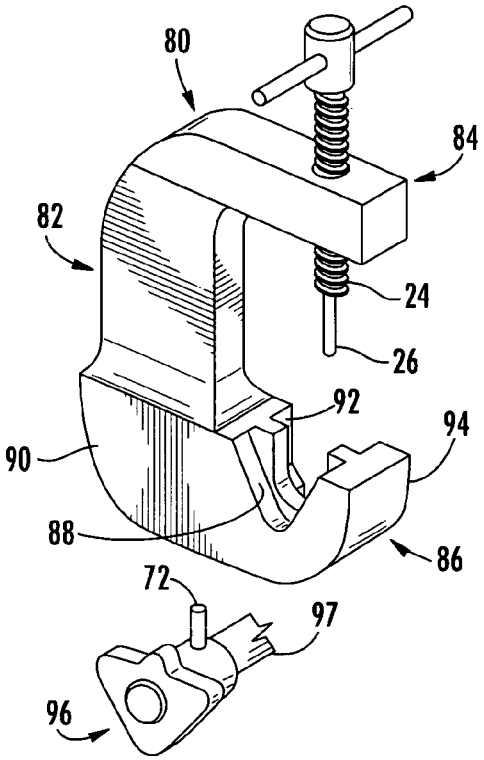
FIG. 10 is substantially a perspective view of another pin driver embodiment.
Figure 11:
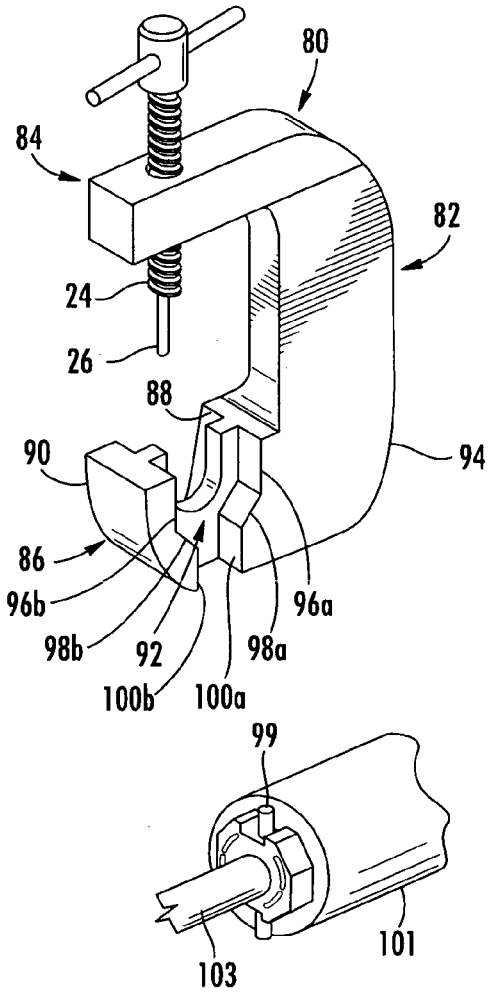
FIG. 11 is substantially another perspective view of the pin driver embodiment of FIG. 10.

Referring now to FIGS. 10 and 11, another embodiment 80 of a pin driver is shown wherein, like pin driver 20, pin driver 80 preferably also includes similar shaft 24 and engagement pin 26. Pin driver 80 may also include a C-shaped tool body 82 that has a first end 84 and a second end 86. The shaft 24 is preferably moveably attached at the first end of the tool body 82. Unlike pin driver 20, the second end of the tool body 82 preferably defines a first groove 88 on a first side 90 and a second groove 92 on a second side 94.

The first groove 88 is preferably shaped to accommodate a printer cartridge portion, such as a drum drive element 96 attached to the side of the printer cartridge (not shown). In the preferred embodiment, the first groove 88 may be a substantially triangular design configured to accommodate a substantially triangular drive element 96. Drive element 96 may be positioned on the first groove 88 such that the V-shape of the drive element 96 sits on the V-shape of the first groove 88. Once the drive element 96 is positioned within the first groove 88, the shaft 24 may be rotated and lowered so that the engagement pin 26 may contact the spring pin 72 and detach the spring pin 72 from the drive element 96. Once the spring pin 72 is detached from the drive element 96, the drive element 96 may be separated from the drive axle 97. The drum axle 97 may then be pulled out of the cartridge to release the drum from the printer cartridge (not shown) so that the drum can be replaced or remanufactured.

Referring to FIG. 11, second groove 92 may define two parallel vertical sides 96*a* and 96*b* that are spaced apart and connected to their respective angled sides 98*a* and 98*b*. Angled sides 98*a* and 98*b* may be connected to their respective shorter vertical sides 100*a* and 100*b*. The space between vertical sides 96*a* and 96*b* is preferably configured to accommodate a plastic drum cap or drum hub of a predefined shape. The spacing between shorter vertical sides 100*a* and 100*b* compared to the spacing between two parallel vertical sides 96*a* and 96*b* is preferably less. The space between vertical sides 100*a* and 100*b* is preferably configured to accommodate the pin being detached from the drum cap. It is noted that the number, design, and placement of the grooves defined by the second end 86 of the pin driver 80 may be varied and still fall within the scope of the present invention.

It is noted that embodiment 80 of the pin driver may also be used to re-attach printer cartridge components held together by a pin. For instance, drive element 96 may be re-attached to the drum axle 97 by inserting a first pin 72 using embodiment 80 of the pin driver. The drum axle 97 may be inserted to the drive element 96, then the first pin 72 may be introduced into the drive element 96. The drive element 96 may then be positioned into the first groove 88 and the pin may be aligned to the shaft 24. The shaft 24 may be pressed against the first pin 72 to drive the first pin 72 into the drive element 96 thereby joining the drive element 96 and the drum axle 97. The drum may be re-attached to the drum axle 97 by inserting the drum axle 97 through the core of the drum. A second pin 99 may be introduced into the drum cap 101. The drum cap 101 may then be positioned into the second groove 90 and the second pin 99 may be aligned to the shaft 24. The shaft 24 may be pressed against the second pin 99 to drive the second pin 99 into the drum cap 101 thereby joining the drum cap 101 with the drum axle 103.

Figure 12:
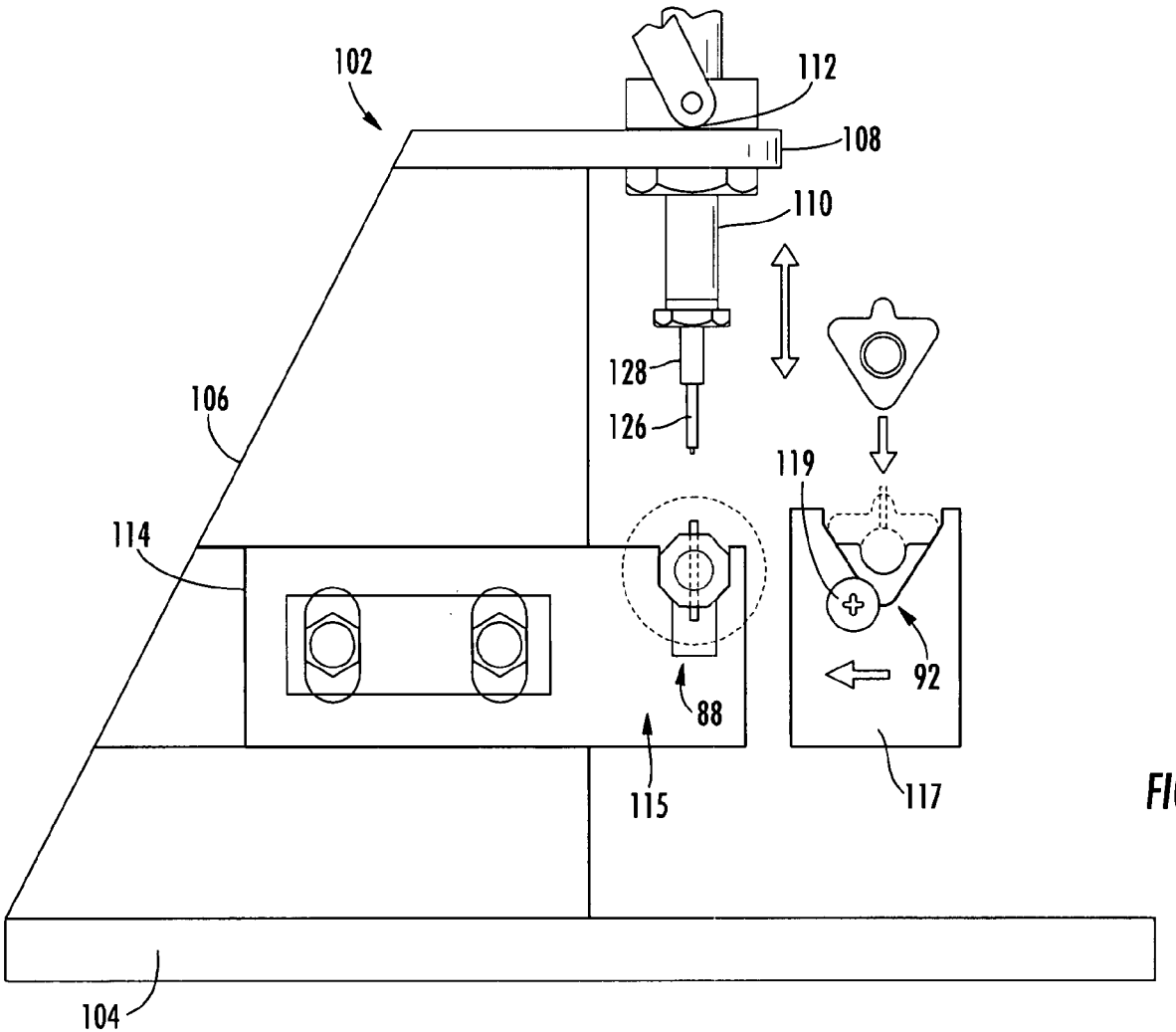
FIG. 12 is substantially a front view of yet another embodiment of a pin driver.

Referring now to FIG. 12, the present invention includes another embodiment of a pin driver 102. Pin driver 102 preferably includes a base 104, a frame 106 attached to the base 104, a driver mount 108 attached to the frame 106, a moveable shaft 110 attached to the driver mount 108, a clamp 112 attached to the shaft 110 for moving the shaft 110, and a cartridge mount 114 attached to the frame 106 for supporting a printer cartridge portion (not shown). The pin driver 102 may also include a pin engaging shaft 126 that preferably has a smaller diameter than shaft 110 and shaft adapter 128 that preferably connects shaft 110 and pin engaging shaft 126. The base 104 preferably provides a flat surface to allow the pin driver 102 to independently stand on a work area. The base 104 may also provide support to the frame 106, which in turn, supports the driver mount 108 and the cartridge mount 114.

The cartridge mount 114 may be attached to the frame 106 at a predefined position wherein it allows the pin that attaches printer cartridge components to be aligned with the engagement shaft 126. The cartridge mount 114 may include a first interchangeable end 115 and a second interchangeable end 117, which may be interchanged depending on the application and may be attached to the cartridge by fasteners 119 known in the art. First interchangeable end 115 may define a first groove 88, and second interchangeable end 117 may define a second groove 92. First groove 88 and second groove 92 may be similar to first groove 88 and second groove 92 discussed above and shown on FIGS. 10 and 11. First groove 88 and second groove 92 may be configured to accommodate printer cartridge portions that are shaped to fit within the appropriate groove thereby allowing the cartridge mount 114 to securely support a printer cartridge portion while the pin is being installed to or detached from printer cartridge components. Again, the number, design, and placement of the grooves may be varied and still fall within the scope of the present invention.

Figure 13A:
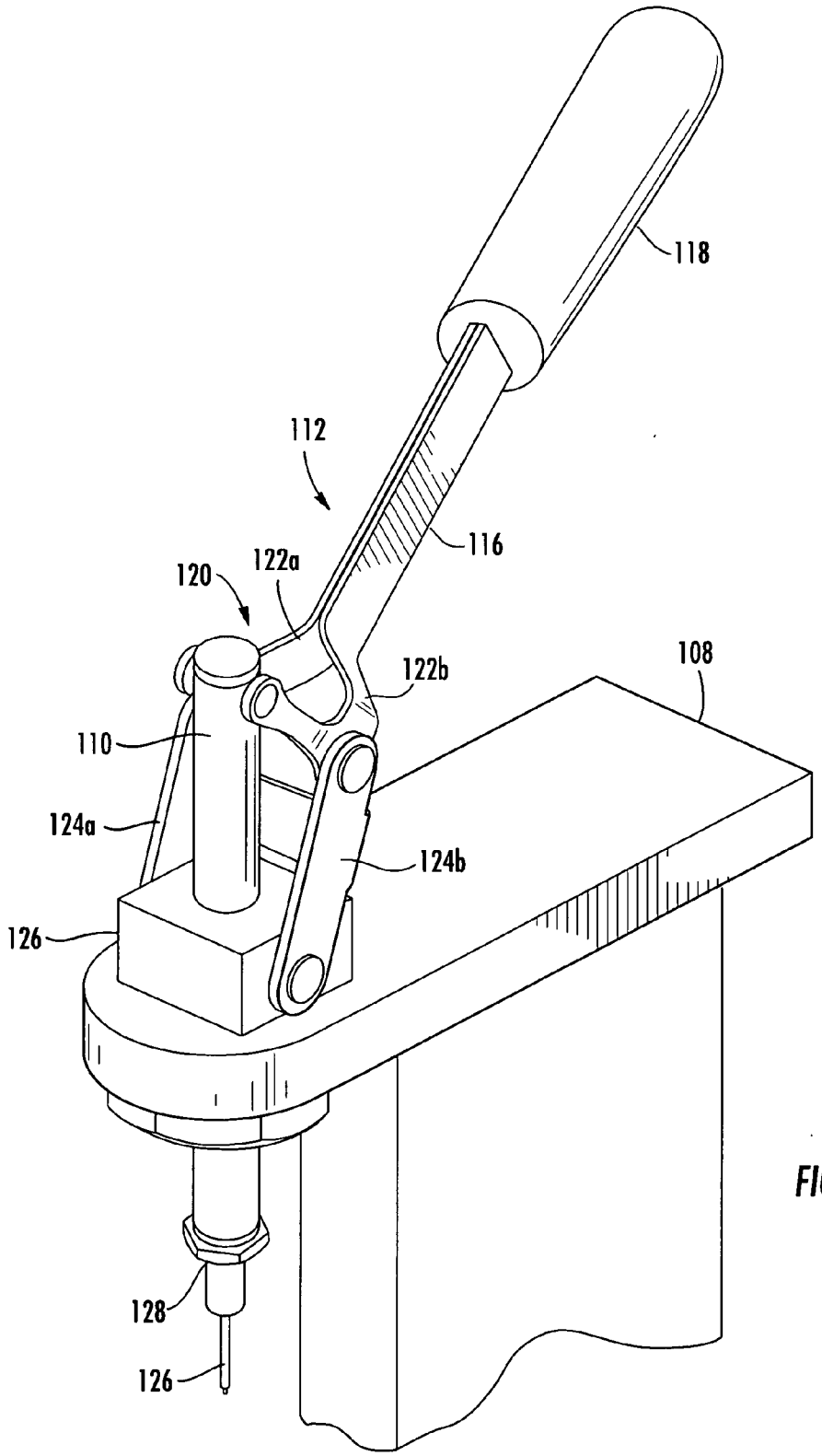
FIG. 13A is substantially a perspective view of the clamp, the driver mount, and the moveable shaft of the pin driver embodiment of FIG. 12.

The driver mount 108 preferably supports the moveable shaft 110 and the clamp 112. The driver mount 108 preferably defines a shaft receiving recess and allows the shaft to move in the shaft receiving recess. The shaft 110 of the pin driver 102 is preferably configured to move in a lateral manner relative to the driver mount 108 as opposed to a rotational manner. Referring now to FIG. 13*a*, the movement of the shaft is preferably caused by the clamp 112. Clamp 112 preferably includes a lever 116 that is connected to a handle 118 on one end and a pivot mechanism 120 at the opposite end. The pivot mechanism 120 preferably causes the lateral pin driving movement of the shaft 110. Pivot mechanism 120 preferably includes a pair of hook arms 122*a* and 122*b* attached to the lever 116 on one end and to the moveable shaft 110 on the other end. Pivot mechanism 120 preferably further includes a pair of angled arms 124*a* and 124*b*, one end of each of which are preferably connected to its respective hook arm at a location that is substantially in the middle portion or the bent portion of the hook arm. The other end of each of the angled arms is preferably attached to a shaft stage 126. The shaft stage 126 is preferably attached to the driver mount 108 and defines a recess for receiving the shaft 110.

Figure 13B:
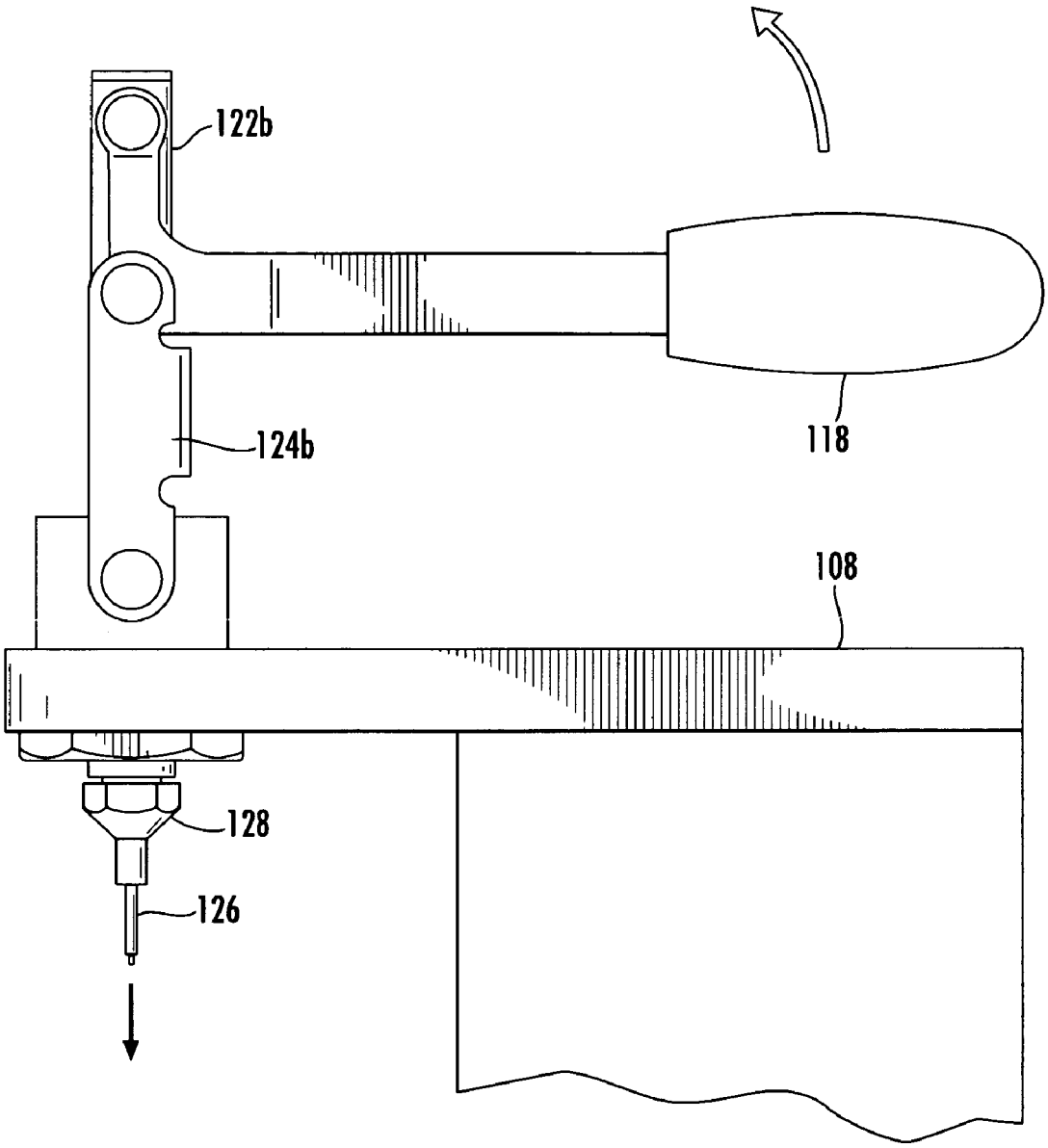
FIG. 13B is substantially a side view of the clamp in a first position, the driver mount, and the moveable shaft of the pin driver embodiment of FIG. 12.
Figure 13C:
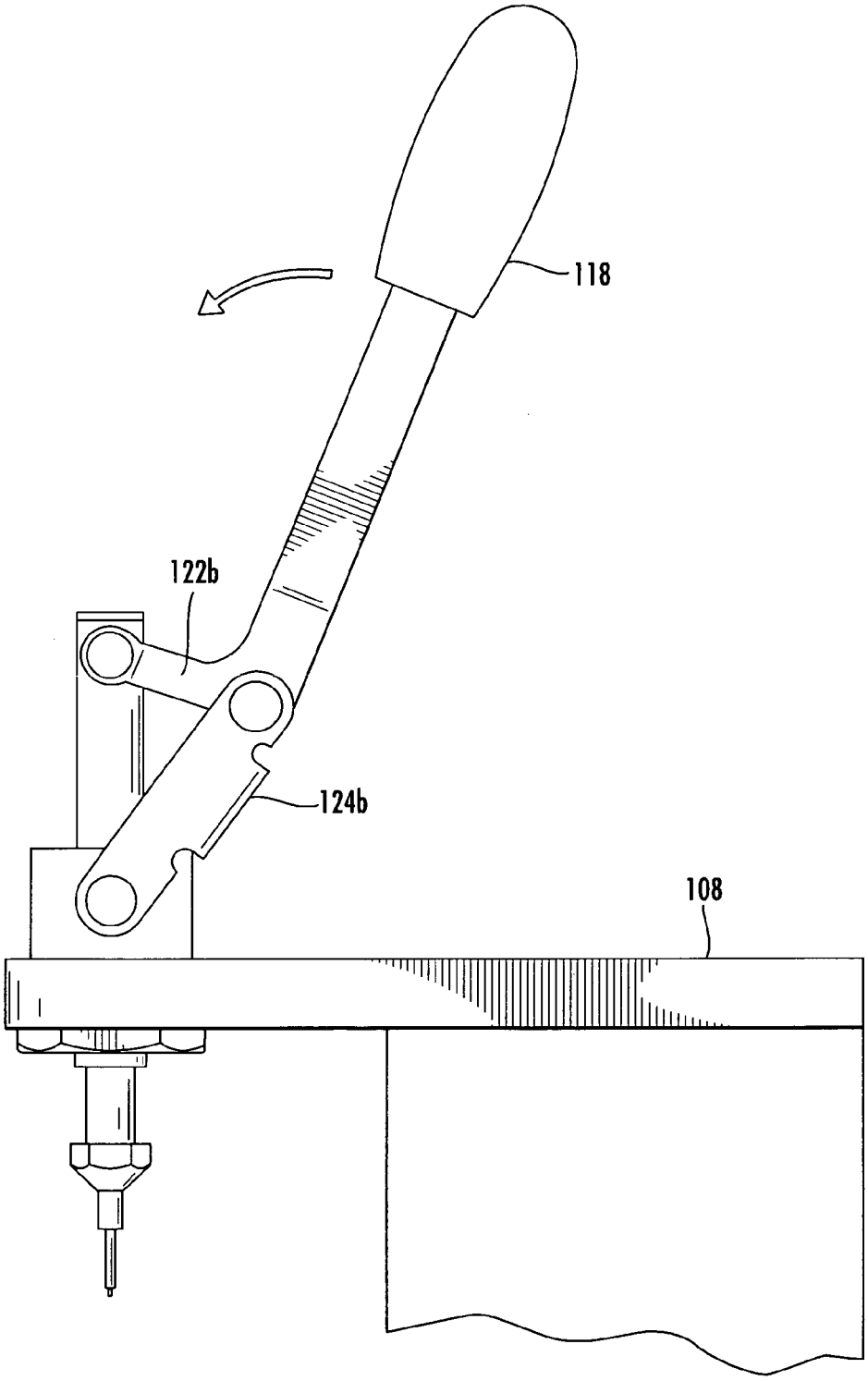
FIG. 13C is substantially a side view of the clamp in a second position, the driver mount, and the moveable shaft of the pin driver embodiment of FIG. 12.

Referring now to FIG. 13*b*, as the handle 118 is moved from a position that is substantially parallel to the driver mount 108 towards a position close to perpendicular to the driver mount 108, the pair of angled arms 124*a* and 124*b* are preferably configured to move from a substantially 90 degree position relative the driver mount 108 towards a position that is approximately 45 degrees relative to the driver mount (FIG. 13*c*). The portions of the pair of hook arms 122*a* and 122*b* that are adjacent to the shaft 110 preferably move from a position substantially 90 degrees relative to the driver mount 108 to a position substantially 135 degrees relative to the driver mount 108 thereby pushing the shaft 110 down towards the ground giving it a driving force. It is noted that the recitation of the angles of positions herein are for description purposes only and are not to limit the invention.

Figure 14:
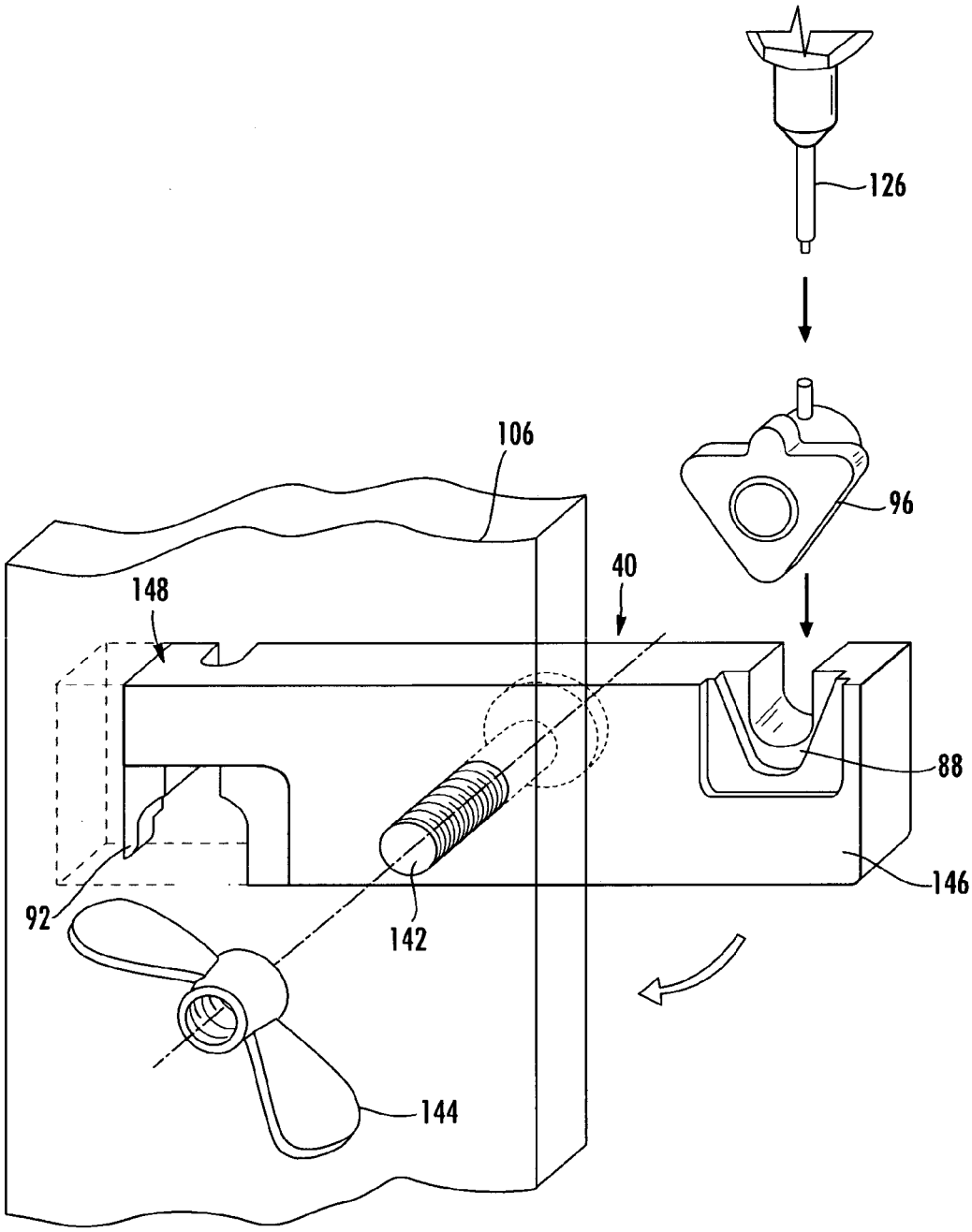
FIG. 14 is substantially a front schematic view of a cartridge mount of a pin driver embodiment of the present invention.
Figure 15:
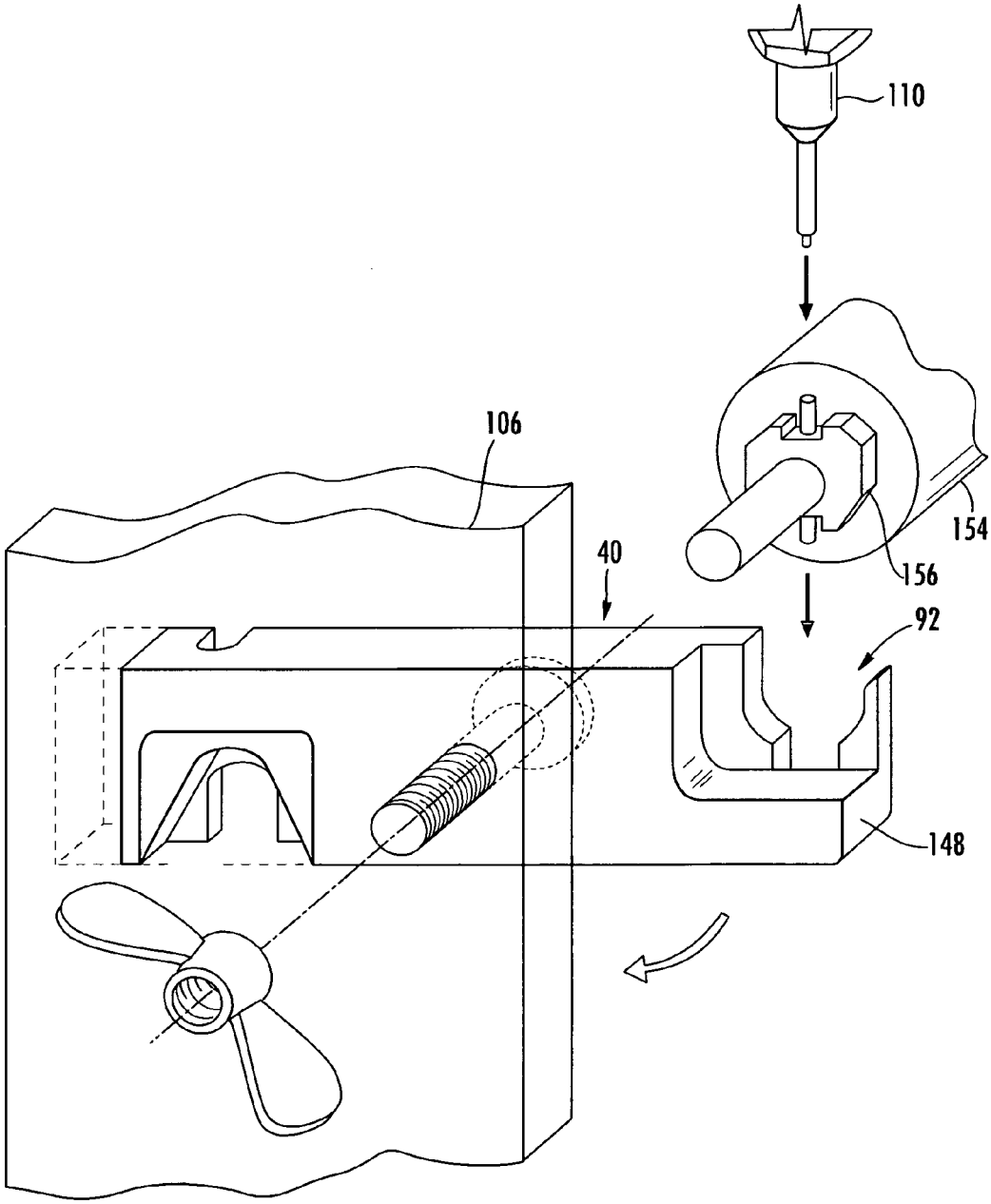
FIG. 15 is substantially a front schematic view of the cartridge mount of FIG. 12 having been flipped to accommodate a different drum type.

Referring now to FIGS. 14 and 15, a different embodiment of a cartridge mount is shown wherein cartridge mount 140 is preferably rotatably mounted to the frame 106 via fasteners known in the art, such as the combination of a bolt 142 and a wing nut 144. The cartridge mount 40 preferably includes a first end 146 and a second end 148. The first end 146 of the cartridge mount 140 preferably defines a first groove 88, which may be a substantially triangular design configured to accommodate a substantially triangular drive element 96 as previously discussed and shown in FIG. 10. The second end 148 preferably defines a second groove 92, which may define two parallel vertical sides 96*a* and 96*b* that are spaced apart and connected to their respective angled sides 98*a* and 98*b* as previously discussed and shown in FIG. 11. The second end 148 may be able to accommodate the drum cap 156 and allow the pin holding the drum cap 156 and the drum axle to be installed within them or detached from them. The cartridge mount 40 may be rotated around the frame 106 so that the appropriate groove can be aligned with the engagement shaft 126. For instance, if a printer cartridge with a triangular drive element 96 needs a pin installed or extracted from the drive axle, then the first groove 88 of the first end 146 may be aligned with the engagement shaft 126. If the drum 154 has a drum cap 156 that needs a pin installed or extracted from the drive axle, then the cartridge mount 140 may be flipped so that the second groove 92 of the second end 148 may be aligned with the engagement shaft 126.

Figure 16:
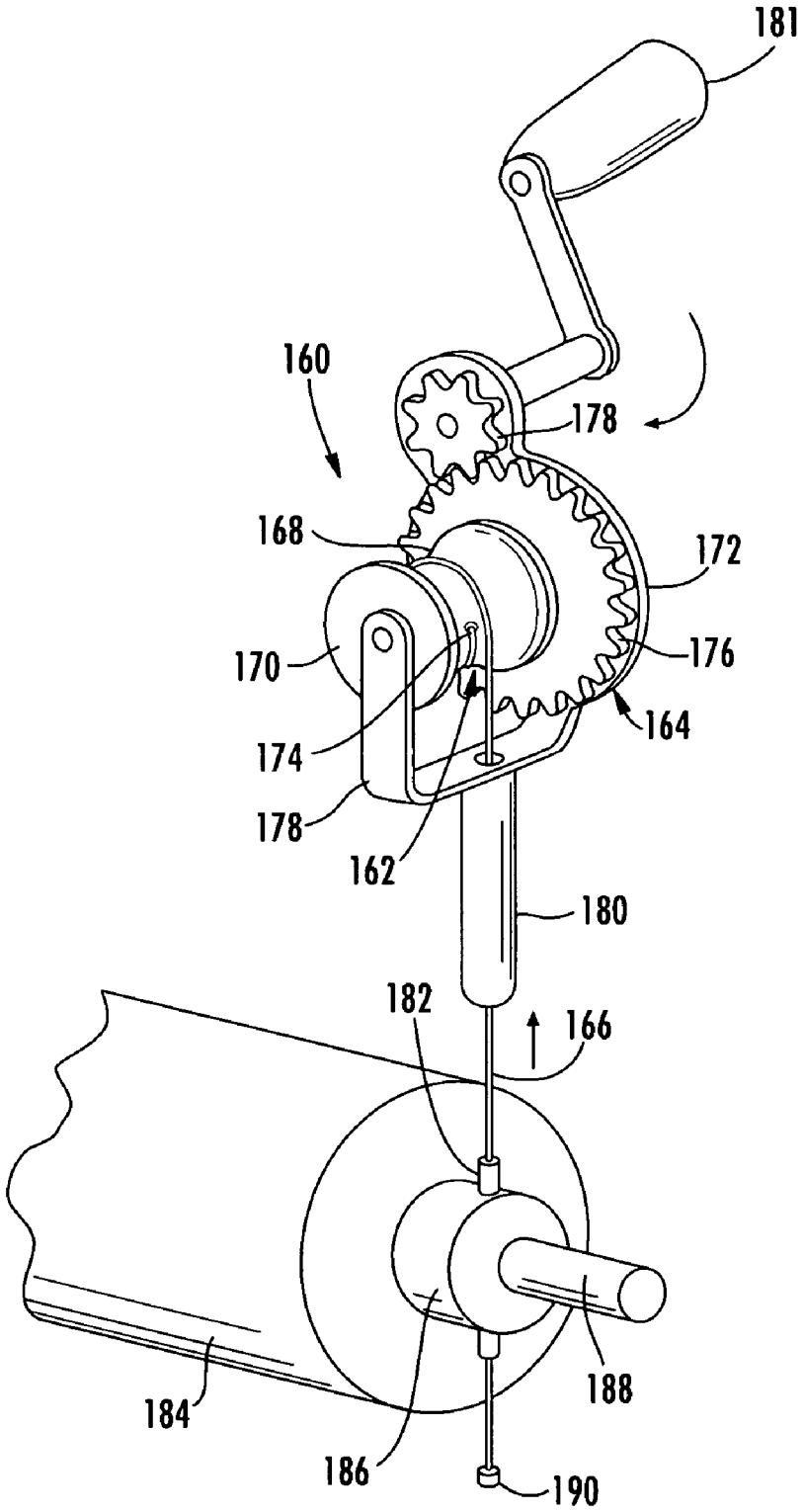
FIG. 16 is substantially a front schematic view of another embodiment of a pin driver of the present invention.
Figure 17:
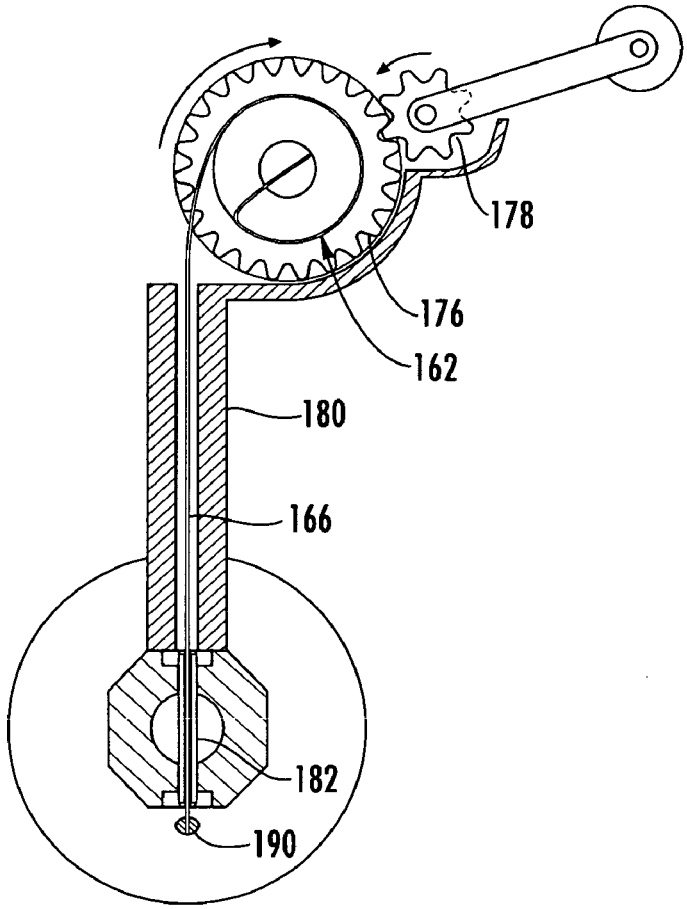
FIG. 17 is substantially a cross-sectional view of the pin driver embodiment of FIG. 16.

With reference now to FIGS. 16 and 17, another embodiment 160 of a pin driver preferably includes a spool 162, a spooling mechanism 164, and an elongate material 166. Spool 162 preferably includes a cylindrical member 168 with rims 170 and 172 attached to the opposite ends of the cylindrical member 168. The cylindrical member 168 preferably defines a recess 174 configured to receive and hold the elongate material 166. The cylindrical member 168, rim 170, and rim 170 are preferably mounted to a support frame 178. Spooling mechanism 164 is preferably attached to rim 172 and preferably includes a first gear 176 and a second gear 178. Each of the first and second gear preferably includes its respective set of gear teeth. First gear 176 is preferably attached to a shaft 180 that extends to a handle 181. The handle 181 may be operated to rotate the first gear 178. The teeth of the first gear 178 contact the teeth of the second gear 176 and rotate the second gear 176. The rotation of the second gear 176 rotates the spool 162 thereby allowing the spool to wind or unwind the elongate material 166. It is noted that motors, pneumatic, or hydraulic spooling mechanisms known in the art may be used in lieu of the manual spooling mechanism 164.

Figure 18:
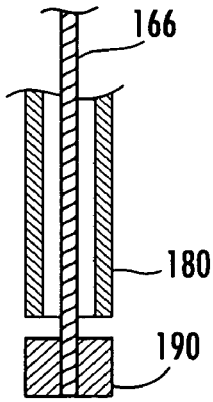
FIG. 18 is substantially a partial cross-sectional view of the elongated member and the pin abutting member of the pin driver embodiment of FIG. 16.
Figure 19:
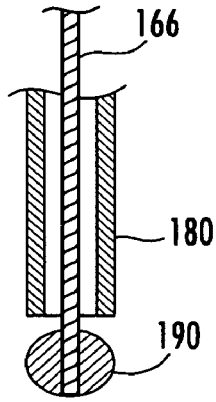
FIG. 19 is substantially a partial cross-sectional view of the elongated member and the pin abutting member of the pin driver embodiment of FIG. 16.

The elongate material 166 may be in a form of a wire, thread, or a string. An elongate material control shaft 180 may be attached to the support frame 178 to substantially prevent side to side movement of the elongate material 166. The elongate material 166 is preferably configured to be inserted through the pin that attaches printer components together. The elongate material 166 is preferably configured to be inserted through the pin 182 that connects the drum 184 and the drum cap 186 to the drum axle 188. The elongate material 166 preferably includes a pin abutting end 190. Pin abutting end 190 may have a square shape (FIG. 18) or a circular shape (FIG. 19). Pin abutting end 190 preferably has a diameter that is bigger than the diameter of the elongate material 166 and smaller than the outer diameter of the pin 182. In use, the pin abutting end 190 may be inserted through the pin 182 followed by the elongate material 166. After the pin abutting end 190 is inserted past the pin 182, spooling mechanism 164 may be activated by rotating the handle 181. The first and second gears of the spooling mechanism 164 preferably rotate causing the spool 162 to rotate and wind the elongate member 166. As the elongate member 166 is wound around the spool 162, pin abutting member 190 abuts the pin 181 and pushes the pin out of the printer cartridge components the pin is holding.

Figure 20:
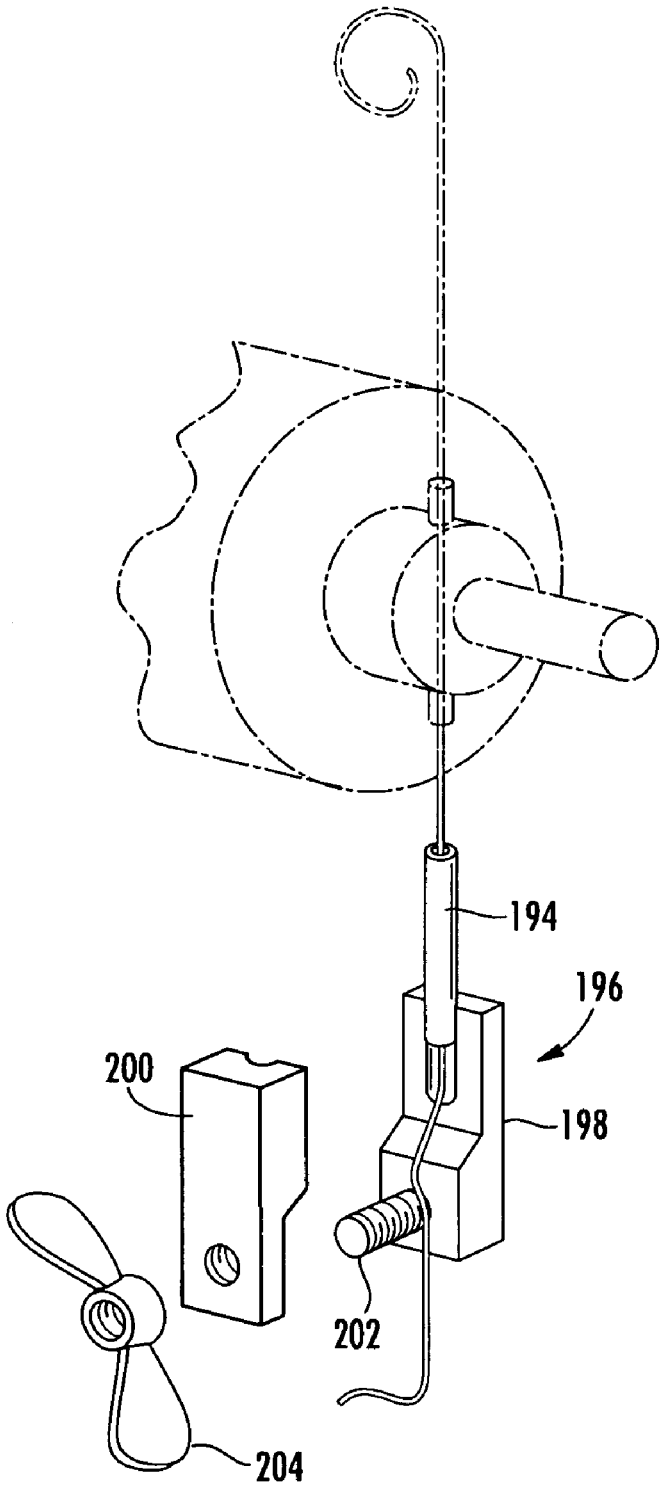
FIG. 20 is substantially an exploded view of a pin abutting member embodiment for the pin driver embodiment of FIG. 16.
Figure 21:
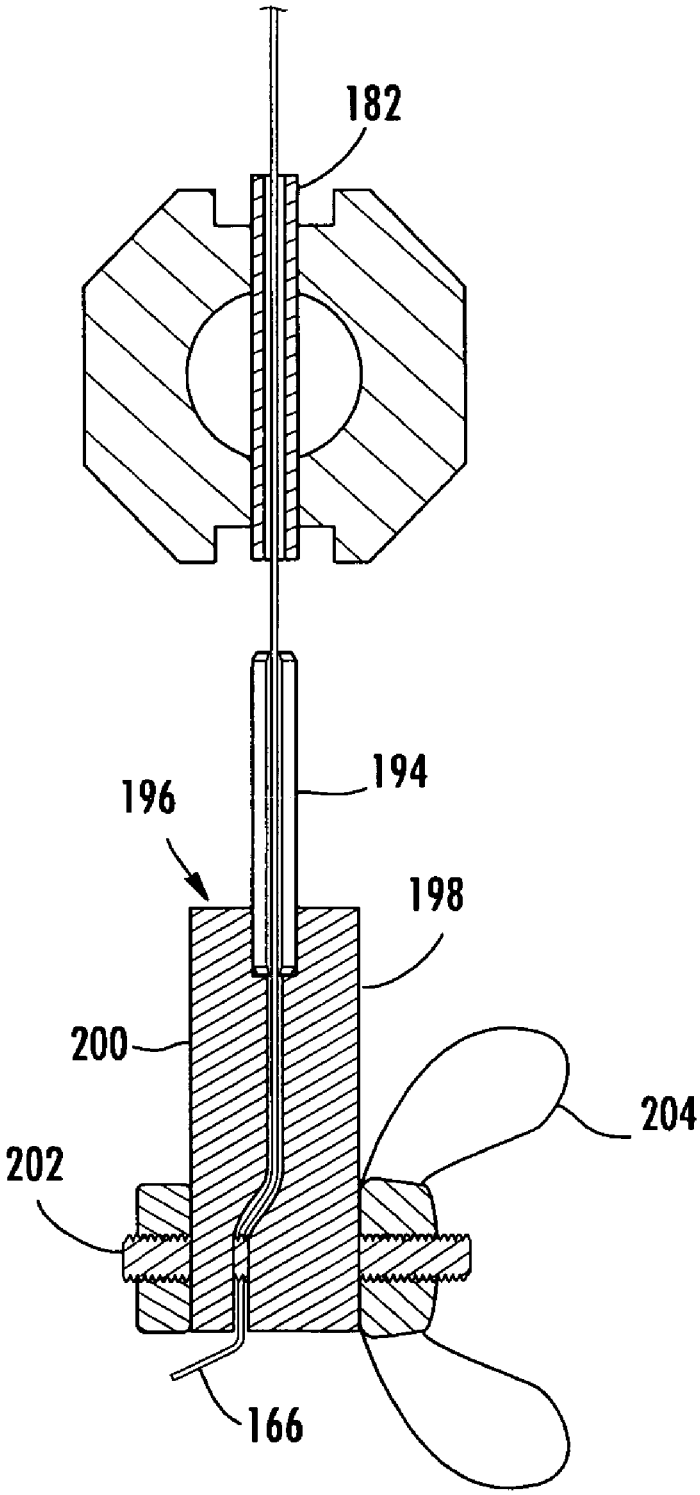
FIG. 21 is substantially a front schematic view of another embodiment of a pin abutting member for the pin driver embodiment of FIG. 16.

Referring now to FIGS. 20 and 21, another embodiment 192 of the pin abutting member is shown and preferably includes a pin abutting shaft 194 attached to a grasping member 196. The pin abutting shaft 194 preferably defines an elongate receiving recess that leads to the grasping member 196. The grasping member 196 is preferably configured to grip the elongate member 196. The grasping member 196 preferably includes a first body 198 attached to the pin abutting shaft 194 and a second body 200, which is removeable from the first body 198. The grasping member 196 preferably also includes a bolt 202 attached to the first body 198 and a nut 204. In use, the elongate member 166 may be inserted through a pin that holds printer cartridge components together. The elongate member 166 may further be inserted through the pin abutting shaft 194. The elongate member 166 may then be positioned in between the first body 198 and the second body 200. The nut 204 may be tightened with the bolt 202 to allow the grasping member 196 to securely hold the pin abutting shaft 194. The spooling mechanism 164 may then be activated by rotating the handle 181. The first and second gears of the spooling mechanism 164 preferably rotate causing the spool 162 to rotate and wind the elongate member 166. As the elongate member 166 is wound around the spool 162, pin abutting shaft 194 abuts the pin 182 and pushes the pin out of the printer cartridge components the pin is holding.

Figure 22:
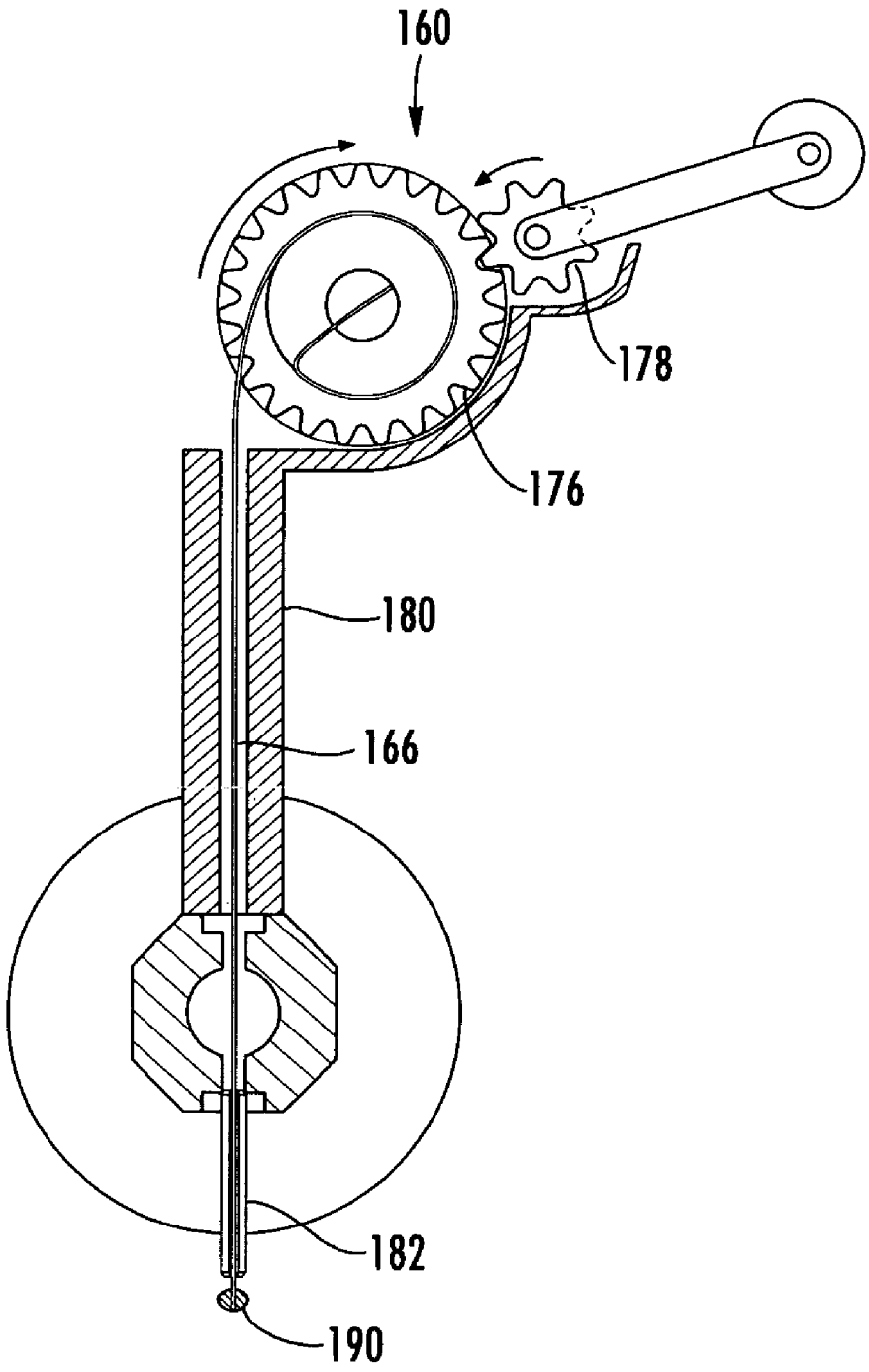
FIG. 22 is substantially a cross-sectional view of the pin driver embodiment of FIG. 16 being used to install the pin to the drum and the drum axle.

With reference now to FIG. 22, pin driver embodiment 160 may be used to install printer cartridge components designed to be joined by a pin. Elongate member 166 may be inserted through a pin receiving recess of printer cartridge components designed to be held by the pin and through the pin 182. Pin 182 may be positioned in between abutting end 190 or pin abutting shaft 194 and spool 168. The spooling mechanism 164 may then be activated by rotating the handle 181. The first and second gears of the spooling mechanism 164 preferably rotate causing the spool 162 to rotate and wind the elongate member 166. As the elongate member 166 is wound around the spool 162, pin abutting end 190 or pin abutting shaft 194 abuts the pin 182 and pushes the pin into the pin receiving recess of the printer cartridge components the pin is designed to hold.

Figure 23:
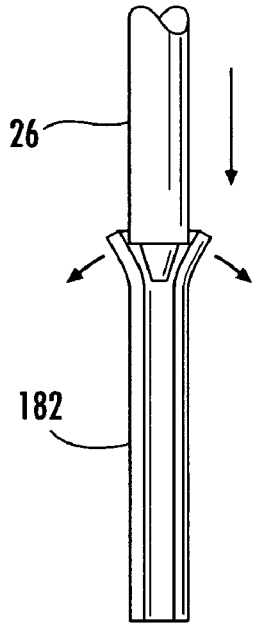
FIG. 23 is substantially a front schematic view of a pin being damaged.
Figure 24:
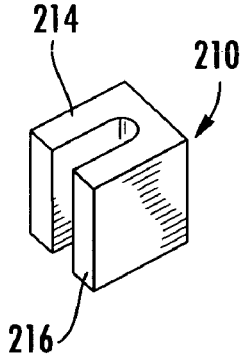
FIG. 24 is substantially a prospective view of a pin guard of the present invention.
Figure 25:
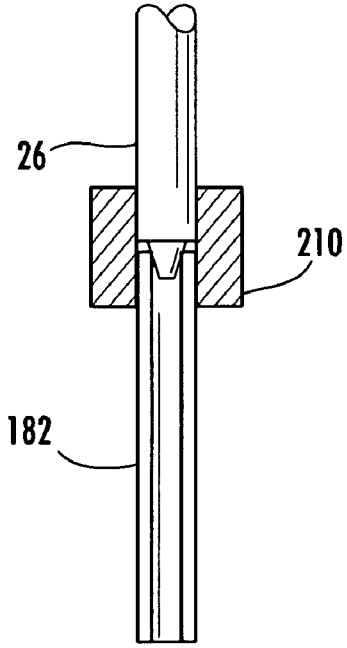
FIG. 25 is substantially a partial schematic view of the pin guard of FIG. 24 being used with a pin driver and pin.

It is noted that the mechanical spring pins that hold printer cartridge components together may be hollow and may be made of soft metal. Mechanical spring pins 182 may easily be damaged when pressure is applied to them by the engagement pin 26 (FIG. 23). The present invention also includes a pin guard 210 that may be in a form of a block of material 214 defining a substantially cylindrical indentation 216 (FIG. 24). When the mechanical spring pin 182 is being installed to or detached from printer cartridge components, the pin guard 210 may be wrapped around the engagement pin 26 or pin abutting shaft and the mechanical spring pin 182 by accommodating the engagement pin 26 or pin abutting shaft and the mechanical spring pin 182 into the cylindrical indentation 216 (FIG. 25). The walls of the block of material 214 of the pin guard may prevent the mechanical spring pin 182 from being deformed.

It can now be realized that certain embodiments of the pin driver of the present invention may ease the steps of detaching or reattaching a variety of printer cartridge components that are held together by a pin. As shown above, certain embodiments can be used for detaching or reattaching drums held to a drum axle by a pin or drive elements held to a drum axle by a pin. The tools and methods of the present invention help minimize the exposure of sensitive parts of the drum to being damaged. For instance, the present invention helps ensure that the parts of the pin driver or the pin removal technique does not alter the physical characteristic hub or cap of the drum, which is often manufactured with soft plastic. The present invention also helps minimize the exposure of the drum spring pin from being damaged. The present invention provides tools and methods that may be desirable in high volume cartridge remanufacturing environments.

Although the description above contains many specifications, these should not be construed as limiting the scope of the invention but as merely providing illustrations of some of the presently preferred embodiments of this invention. For example, the lengths and the numbers of the various shafts of the pin driver may be varied. The shape and the thickness of the tool body may be varied. The invention is capable of other embodiments and of being practiced and carried out in various ways. The invention is not limited in its application to the details of the construction and to the arrangement of the components set forth in the above description or as illustrated in the drawings.

What is claimed is:

1. A device for remanufacturing a printer cartridge, the printer cartridge comprising at least two printer cartridge components attached together by a pin, the device comprising:

a. a shaft configured to apply pressure to the pin;

b. a frame connected to the shaft, the frame configured to provide support to the shaft;

c. a cartridge mount connected to the frame, the cartridge mount configured to support a cartridge portion when the shaft applies pressure to the pin, and further wherein the cartridge mount comprises a plurality of grooves, each of the plurality of grooves comprising a distinct shape to accommodate a plurality of printer cartridge components.

2. The device of claim 1, further comprising a base connected to the frame, the base comprising a substantially flat surface, the base configured to allow the device to be substantially self-supporting.

3. The device of claim 1, wherein the cartridge mount comprises at least one groove, the groove being shaped to accommodate a plastic drum cap.

4. The device of claim 1, wherein the cartridge mount is moveably attached to the frame to position a groove selected from the plurality of grooves adjacent to the shaft.

5. The device of claim 1, further comprising a clamp attached to the shaft, the clamp configured to move the shaft to apply pressure to the pin.

6. The device of claim 1, further comprising a pin guard for protecting the pin.

7. A device for remanufacturing a printer cartridge, the printer cartridge comprising printer cartridge components joined by a pin, the device comprising:

a. a shaft means for pressing on the pin;

b. a support means for supporting the shaft means, the support means being connected to the shaft means; and, c. a drive means for driving the shaft against the pin, the drive means being connected to the support means, wherein the support means comprises a wire and the drive means comprises a set of gears configured to wind and unwind the wire.

8. The device of claim 7, wherein the drive means is configured to rotate.

9. The device of claim 7, wherein the drive means is configured to move linearly.

10. The device of claim 7, further comprising a cartridge portion support means for supporting a printer cartridge portion, the cartridge portion support means being attached to the support means.

11. The device of claim 7, further comprising a base means for allowing the support means to stand on its own, the base means being connected to the support means.

12. A method of remanufacturing a printer cartridge, the printer cartridge comprising printer cartridge components fastened together by a pin, the method comprising the steps of:

a. providing a device, the device comprising:

i. a shaft configured to apply pressure to the pin;

ii. a support means for supporting the shaft, the support means being connected to the shaft; and, a drive means for driving the shaft against the pin, the drive means being connected to the support means, and wherein the support means comprises a wire and the drive means comprises a set of gears configured to wind and unwind the wire; and, b. applying pressure to the pin using the device.

13. The method of claim 12, wherein the printer cartridge comprises a drum cap attached to a drum axle by a pin, the method further comprising detaching the pin from the drum cap.

14. The method of claim 12, wherein the printer cartridge comprises a drum, the drum comprising a drum cap attached to a drum axle by a pin, the method further comprising inserting the pin through the drum cap and the drum axle to fasten the drum to the drum axle.

15. The method of claim 12, wherein the printer cartridge comprises a drive element configured to attach a drum axle to the printer, the drive element being attached to the drum axle by a pin, the method further comprising detaching the pin from the drive element and the drum axle.

16. The method of claim 12, wherein the printer cartridge comprises a drive element configured to attach a drum axle to the printer, the method further comprising inserting the pin through the drive element and the drum axle.

17. The method of claim 12, further comprising supporting the device with a base to allow the device to stand on a surface substantially independently.

18. The method of claim 12, further comprising supporting a portion of the printer cartridge while the pressure is being applied on the pin.

* * * * *